US006779445B2

(12) United States Patent
Schaede

(10) Patent No.: US 6,779,445 B2
(45) Date of Patent: Aug. 24, 2004

(54) INTAGLIO PRINTER

(75) Inventor: Johannes George Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/169,765

(22) PCT Filed: Dec. 16, 2000

(86) PCT No.: PCT/DE00/04504

§ 371 (c)(1),
(2), (4) Date: Jul. 22, 2002

(87) PCT Pub. No.: WO01/54904

PCT Pub. Date: Aug. 2, 2001

(65) Prior Publication Data

US 2003/0010233 A1 Jan. 16, 2003

(30) Foreign Application Priority Data

Jan. 25, 2000 (DE) ..... 100 02 674
May 25, 2000 (DE) ..... 100 25 996

(51) Int. Cl.[7] ..... B41F 9/00

(52) U.S. Cl. ..... 101/153; 101/152; 101/154; 101/162; 101/216; 101/350

(58) Field of Search ..... 101/153, 350, 101/152, 154, 165, 216

(56) References Cited

U.S. PATENT DOCUMENTS

| | | | | |
|---|---|---|---|---|
| 4,036,130 A | * | 7/1977 | Giori | 101/170 |
| 4,604,951 A | * | 8/1986 | Ichikawa et al. | 101/153 |
| 5,255,599 A | | 10/1993 | Kobayasi et al. | |
| 5,282,417 A | | 2/1994 | Germann | |
| 5,671,671 A | | 9/1997 | Wyssmann et al. | |
| 6,202,554 B1 | | 3/2001 | Kamoda | |

FOREIGN PATENT DOCUMENTS

| | | |
|---|---|---|
| DE | 197 46 268 A1 | 4/1999 |
| EP | 0 343 106 A2 | 11/1989 |
| EP | 0 351 366 B1 | 12/1993 |
| EP | 0 723 864 A1 | 7/1996 |
| EP | 0 864 421 A1 | 9/1998 |
| EP | 0 982 131 A2 | 3/2000 |
| GB | 511049 | 8/1939 |

* cited by examiner

*Primary Examiner*—Andrew H. Hirshfield
*Assistant Examiner*—Marvin Crenshaw
(74) *Attorney, Agent, or Firm*—Jones, Tullar & Cooper PC

(57) ABSTRACT

An intaglio printer has a form or plate cylinder and a printing or counterpressure cylinder. In addition, at least one screen printing cylinder is provided and transfers screen printing ink to the form or plate cylinder.

14 Claims, 4 Drawing Sheets

INTAGLIO PRINTER

FIELD OF THE INVENTION

The present invention is directed to an intaglio printer having a form cylinder and a printing cylinder. A screen cylinder is used to transfer ink to the form cylinder. A collecting cylinder can be associated with the form cylinder.

BACKGROUND OF THE INVENTION

EP 03 43 106 A2 has disclosed a printer with an engraved intaglio printing plate, which is disposed on a form cylinder. A printing cylinder, in which the engraved intaglio printing plate can be simultaneously used as a wet offset printing plate for an additional offset printing unit is also provided.

A printer with an intaglio printing unit that has a form cylinder and a printing cylinder is also known from EP 03 51 366 B1. In this printer, the intaglio printing unit is combined with an indirectly functioning printer unit from which sheets printed by it are fed with the aid of an interposed sheet-feeding apparatus.

Printers of this kind permit superimposed printing with various techniques on the same print stock with a high degree of register preservation. They are therefore preferred for the printing of documents that require a high degree of counterfeit prevention such as banknotes, securities, identification documents, etc.

EP 08 64 421 A1 describes a printer with ink application devices that can be replaced for different printing processes.

EP 05 63 007 A1 discloses an intaglio printer whose plate cylinder has an additional screen printing cylinder disposed against it. This is in addition to the master or pattern cylinder that is disposed against the cylinder.

DE 197 46 268 A1 discloses the application of lacquers of different viscosities by the use of different printing processes.

GB 511 049 A describes a printer in which an engraved plate cylinder is associated with screen printing cylinders.

SUMMARY OF THE INVENTION

The object of the present invention is to produce an intaglio printer.

The object is attained according to the present invention by the provision of an intaglio printer with a form cylinder and a printing cylinder. At least one screen printing cylinder transfers ink to the form cylinder. A collecting cylinder may be associated with the form cylinder. At least one screen printing cylinder is associated with the collecting cylinder.

The advantages that can be achieved with the present invention are comprised particularly in the fact that the present invention permits tactilely discernible features to be printed in a simple fashion and with a high degree of register preservation in relation to other printing motifs. The affixing of such tactilely discernible motifs is particularly desirable in monetary bills in order to also permit visually impaired people to be able to reliably recognize banknotes and to differentiate between their various denominations.

The printing plate of the form cylinder of such a machine preferably has recesses, which can be not only recesses for containing printing ink, but can also have screen printing ink which can be intentionally introduced into such recesses in order to then print with a profile that corresponds to the form of the recess.

The intaglio printing process performed using the printer in accordance with the present invention is preferably a collecting printing process. There is a collecting cylinder to which different printing inks to be printed are respectively applied one after the other, preferably with the aid of master or pattern cylinders, and the entire intaglio printed motif thus produced is transferred to the print stock in a single passage of the print stock through the printing nip.

In a first preferred embodiment of the present invention, a screen printing cylinder is disposed against the form cylinder. In terms of the production direction, the screen printing cylinder can be disposed after a wiping device, which is intrinsically known for intaglio printing, so that the screen printing process occurs essentially uninfluenced by the intaglio printing. The screen printing cylinder, however, can also be disposed against the form cylinder before such a wiping device so that the screen printing ink is wiped in the same way as the printing ink.

In a second preferred embodiment of the present invention, the screen printing cylinder is disposed against the collecting cylinder and applies the screen printing ink to it first.

BRIEF DESCRIPTION OF THE DRAWINGS

Preferred embodiments of the present invention are shown in the drawings and will be described in detail below.

DESCRIPTION OF THE PREFERRED EMBODIMENTS

Figure 1:
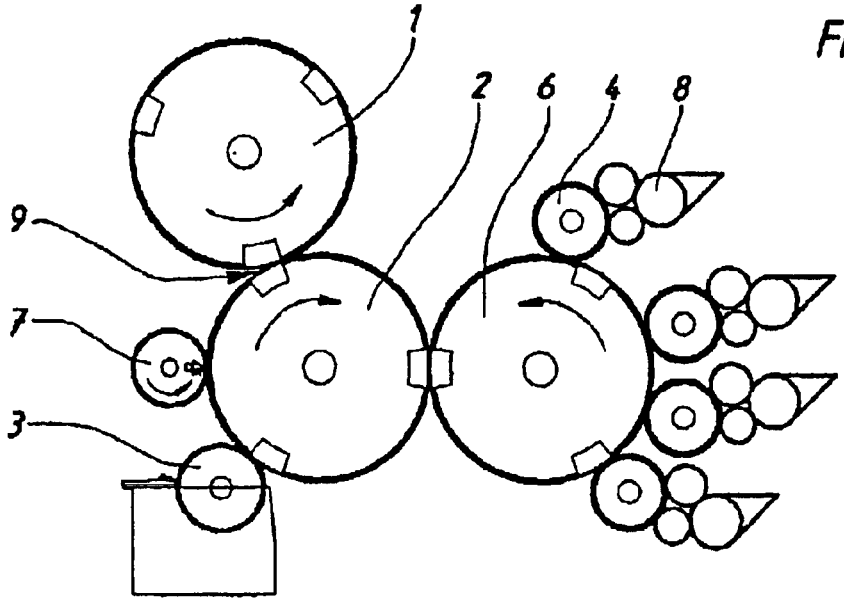
FIG. 1 shows a schematic side elevation sectional view through a first preferred embodiment of an intaglio printer in accordance with the present invention.

The first preferred embodiment of the intaglio printer of the present invention, shown in a schematic section in FIG. 1, has a number of inking units 8, each of which inking units 8 cooperates with an associated master or pattern cylinder 4 and each of which inking units 8 transfers a separate colored ink to raised areas of the associated master or pattern cylinder 4. The several master or pattern cylinders 4, in turn, cooperate with a collecting cylinder 6 to which they each transfer the colored ink that they have received from the respective inking units 8 associated with them. In this manner, a multicolor ink pattern is produced on the collecting cylinder 6, whose colored zones respectively correspond to the raised areas of the several master or pattern cylinders 4.

The collecting cylinder 6, in turn, cooperates with a form cylinder 2, e.g. a plate cylinder 2, on which intaglio printing plates are mounted, in particular steel engraved intaglio printing plates. These intaglio printing plates on the form cylinder 2 are inked during in contact with the collecting cylinder 6 in accordance with the last inking pattern produced on the collecting cylinder 6. The printing ink on the collecting cylinder 6, as that ink passes through the nip between the plate cylinder 2 and the collecting cylinder 6, is essentially pressed into etched or engraved fine channels 11 on the intaglio printing plate on form cylinder 2, which etched or engraved fine channels 11 correspond to a detailed pattern to be printed on the print stock. In the production direction, after the nip defined by the form cylinder 2 and the collecting cylinder 6, i.e. in the clockwise direction, as shown in FIG. 1, there is a wiping device 3, which removes the remainder of the printing ink, which has not found space in the fine channels 11, from the surface of the form or plate cylinder 2.

A screen printing cylinder 7 of a screen printing unit is disposed against the circumference of the plate cylinder 2, after the wiping device 3. This screen printing cylinder 7 applies a screen printing ink to large recesses 12 formed in the printing plates of the form or plate cylinder 2, which printing plates have already had the printing ink applied to the fine channels 11 by the collecting cylinder 6 and have been wiped by the wiping device 3.

In a second or subsequent nip 9 in the production direction, which is formed between the form or plate cylinder 2 and a printing or counterpressure cylinder 1, all of the colors applied to both the fine channels 11 and to the large recesses 12 of the printing cylinder 2 are then printed onto a print stock, in particular onto sheets of paper, which are supplied to the nip 9 by a feeding device that is not specifically shown in FIG. 1.

The first preferred embodiment of the printer in accordance with the present invention thus produces a complete transfer image on the form or plate cylinder 2, which image contains all of the colors of the image to be printed and is transferred to the print stock in a single passage through the nip. This apparatus of the present invention makes it possible to position the screen printing pattern on the printing plates carried on the plate or form cylinder 2 with an extremely high degree of precision in relation to the intaglio printing pattern and thus to achieve a degree of register preservation, which cannot be achieved in two printing actions separated by a step of feeding the print stock.

With this printer, a suitable screen printing ink is selected, which has a high viscosity in comparison to the gravure ink placed on the surface of the printing cylinder 1, in order to prevent the screen printing ink, which is applied to the flat surfaces of the printing plates, from being flattened to an undesirably excessive degree during passage through the nip 9, which could lead to a muddy print image and which would also impair the tactile discernibility of the resulting screen printing pattern on the finished printed product.

Figure 2:
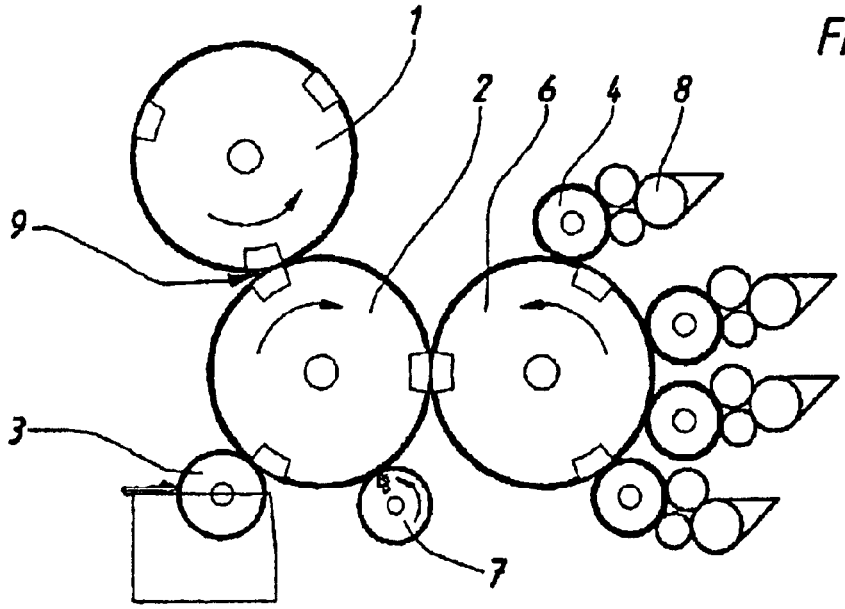
FIG. 2 shows a corresponding side elevation sectional view through a second preferred embodiment of the intaglio printer of the present invention.
Figure 3:
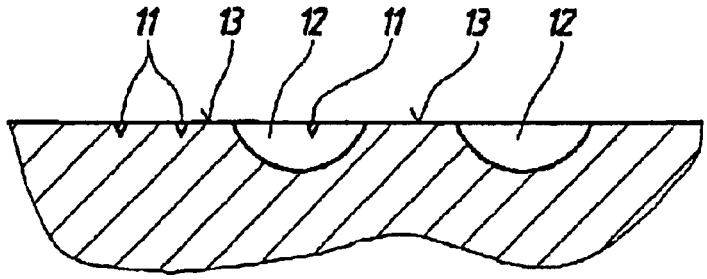
FIG. 3 shows a sectional view of the surface of an intaglio printing plate used in the intaglio printer.

The second preferred embodiment of the intaglio printer in FIG. 2, differs from the first preferred embodiment depicted in FIG. 1 through the placement of the screen printing cylinder 7 in the production direction after the collecting cylinder 6 and before the wiping device 3. FIG. 3 shows a sectional view of a printing plate for use in this printer. Between flat, non-printing regions 13, the surface of the printing plate shown in FIG. 3 has fine channels 11 and larger recesses 12. The fine channels 11 can intersect with the large recesses 12. The fine channels 11 are used for containing the gravure printing ink from the collecting cylinder 6, whereas the larger recesses 12 are provided for containing screen printing ink supplied by the screen printing cylinder 7. When the form or plate cylinder 2, which has been inked with both gravure printing ink and screen printing ink, passes through the wiping device 3, the flat regions 13 of the printing plate are freed of ink, while the applied ink remains in the channels 11 and in the recesses 12, and is transferred to the print stock during passage of the print stock through the nip 9. As is clear, in this second preferred embodiment, the printing plates therefore carry not only the intaglio printing pattern, but also the screen printing pattern. A flattening of regions of the printing plates, which have been inked with screen printing ink during passage through the nip 9, is prevented in this embodiment because the pressure acting in the nip 9 between the flat regions 13 of the printing plate and the print stock or the printing cylinder 1 prevents the screen printing ink from escaping laterally from the recesses 12. The screen printing ink here is applied to the print stock in a contour, which corresponds to the depth profile of the large recesses 12. This permits the production of a very accurate and reproducible print image.

Figure 4:
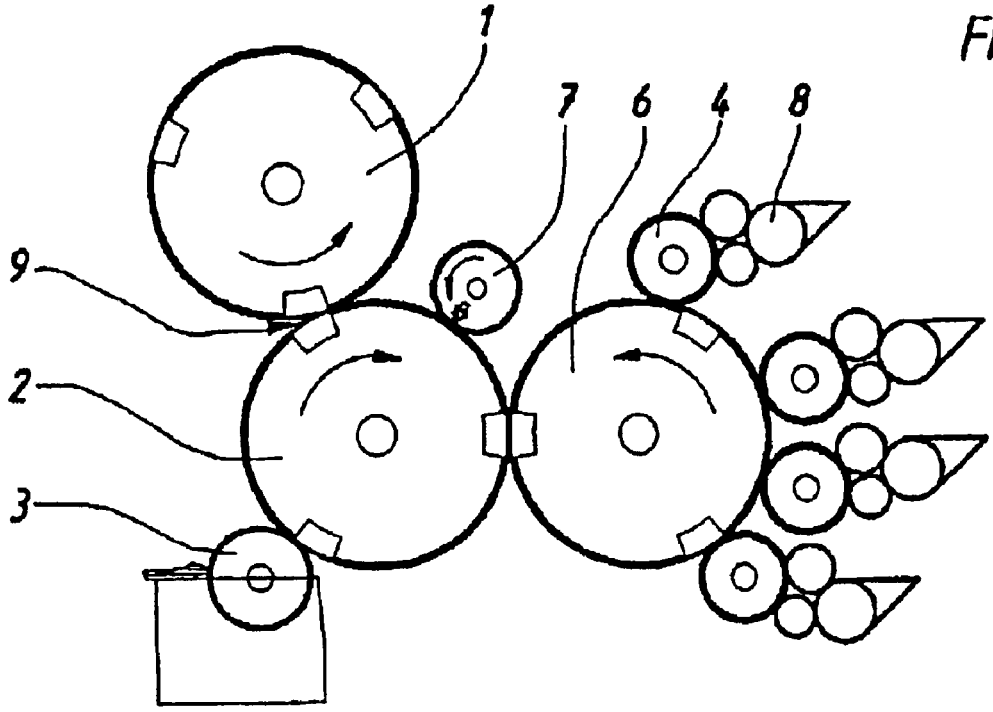
FIGS. 4 and 5 each show a side elevation sectional view through a third and fourth preferred embodiment, respectively of the intaglio printer of the present invention.

In the third preferred embodiment of the intaglio printer, as shown in FIG. 4, a screen printing cylinder 7 is disposed before the collecting cylinder 6 in the production direction. With the use of a printing plate as shown in FIG. 3, the large recesses 12 are already filled with screen printing ink when the inking of the printing plate with printing ink from the collecting cylinder 6 occurs. Since there cannot be any printing ink in the recesses 12 of the printing plate when screen printing ink is being applied to it in the third embodiment of the intaglio printer depicted in FIG. 4, this largely prevents any possible color adulteration of the screen printing ink by printing ink on the finished printed product.

Figure 5:
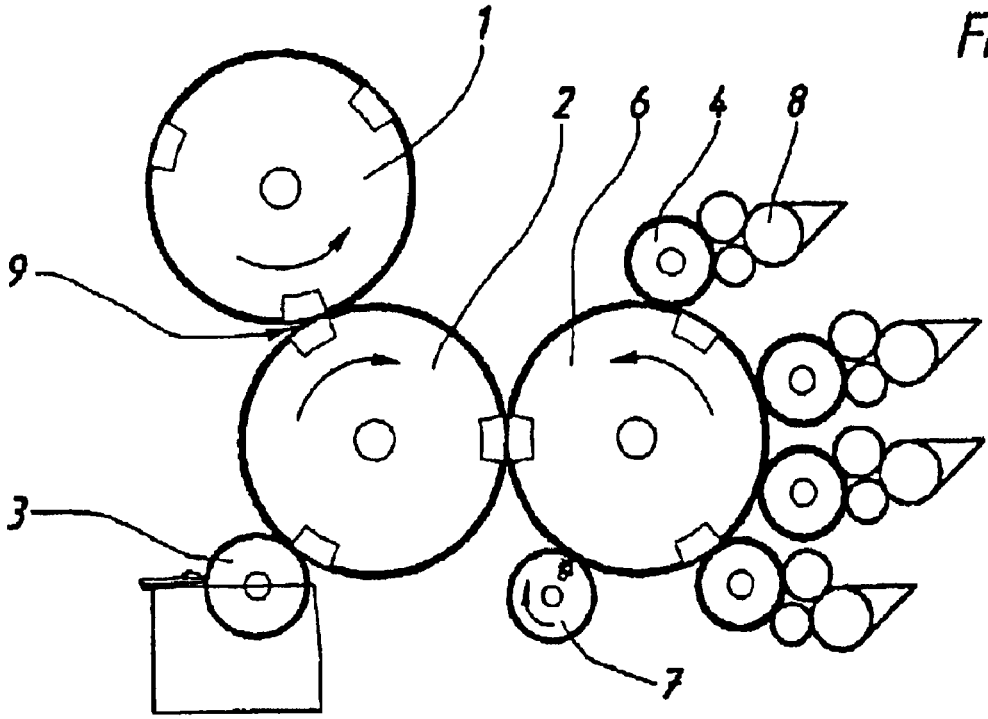

FIG. 5 shows the fourth preferred embodiment of the intaglio printer in accordance with the present invention, which fourth preferred embodiment differs from the above described three embodiments of the subject intaglio printer in that the screen printing cylinder 7 is disposed against the collecting cylinder 6 instead of against the plate cylinder 2. It can be situated before the first master or pattern cylinder 4 in the production direction, as shown in FIG. 5, or after it. In this fourth preferred embodiment as well, if the screen printing ink applied to the plate cylinder 2 passes through the wiping device 3, then the effects and advantages of this fourth embodiment correspond essentially to those described in relation to the embodiments in FIGS. 2 and 4.

Figure 6:
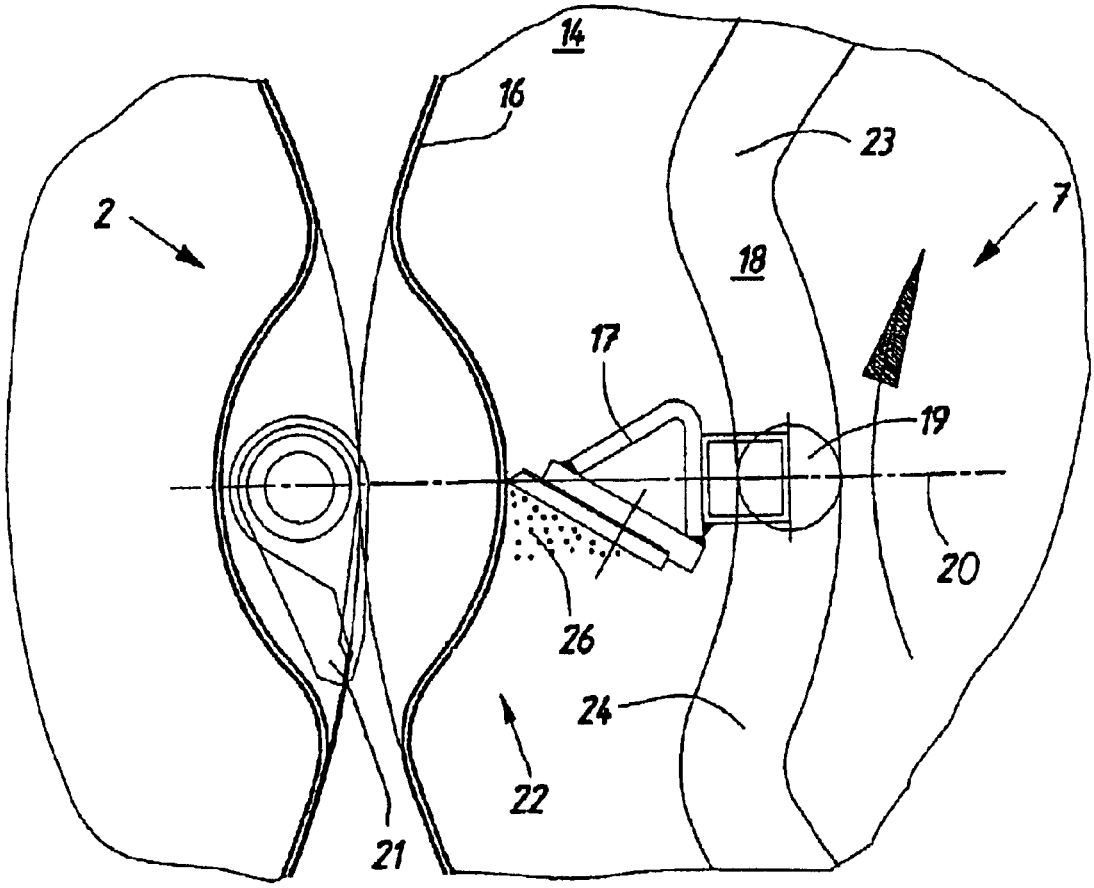
FIGS. 6 and 7 each show a partial side elevation sectional view through a screen printing cylinder in accordance with the present invention.

In the partial section view, as presented in FIG. 6, there is shown a configuration of the screen printing cylinder 7 of the present invention, which configuration, particularly in the embodiments in FIGS. 1, 2, and 4, is advantageous when the form or plate cylinder 2 has circumference regions, which diverge from the exact cylindrical form, for example due to the provision of sheet or plate grippers 21 located on the surface or circumference of plate cylinder 2 . FIG. 6 shows the region of the nip formed between the screen printing cylinder 7 and the form or plate cylinder 2. On each of its axial ends, the screen printing cylinder 7 has a support ring 14, whose outer circumference has a screen 16 stretched onto it, which screen 16 may be made of silk or polyamide gauze or bronze wire mesh. On the interior of the screen printing cylinder 7, a doctor blade 17 is provided, whose position in the radial direction, i.e. in the horizontal direction, as depicted in FIG. 6, is controlled by a curved body, in this instance a guide slot 18 located at the ends of the screen printing cylinder 7. A cylindrical guide projection 19 of the doctor blade 17 passes through and rides in the guide slot 18.

Outside the screen printing cylinder 7, the guide projection 19 is supported at both ends so that it can move along a line 20 connecting the axes of rotation of the two cylinders 2 and 7. FIG. 6 shows the doctor blade 17 in a position in which the sheet gripper 21 of the form or plate cylinder 2 is passing through the nip between the two cylinders 2 and 7. Opposite the sheet gripper 21, the screen 16 has a circumference region 22 that is indented radially inward. The guide slot 18 has an arc-shaped section 23, which is not shown in its entirety in FIG. 6, and which is concentric to the cylindrical outer surface of the screen 16. Guide slot 18 also has an inwardly indented section 24, whose curvature corresponds to that of the circumference region 22. The curvature of the inwardly indented section 24 of the guide slot 18 is selected so that when the inwardly indented section 24 passes by the guide projection 19 during the rotation of the screen printing cylinder 7, the doctor blade 17 is retracted inwardly sufficiently so that it exerts only a minimal pressure against the screen 16, which thus produces no appreciable deformations of the screen 16 in the circumference section 22. Alternatively, the doctor blade 17 is retracted so far radially inwardly that it loses all contact with the screen 16 and consequently exerts no pressure on its circumference section 22, which could deform this circumference section and could possibly damage it during the course of operation. By contrast, when the guide projection 19 is traveling in the section 23 of the guide slot 18, the doctor blade 17 presses against the inside of the screen 16 so that ink 26 disposed against the doctor blade 17 is pushed through the open regions of the screen 16 and is thus applied to the plate cylinder 2.

Figure 7:
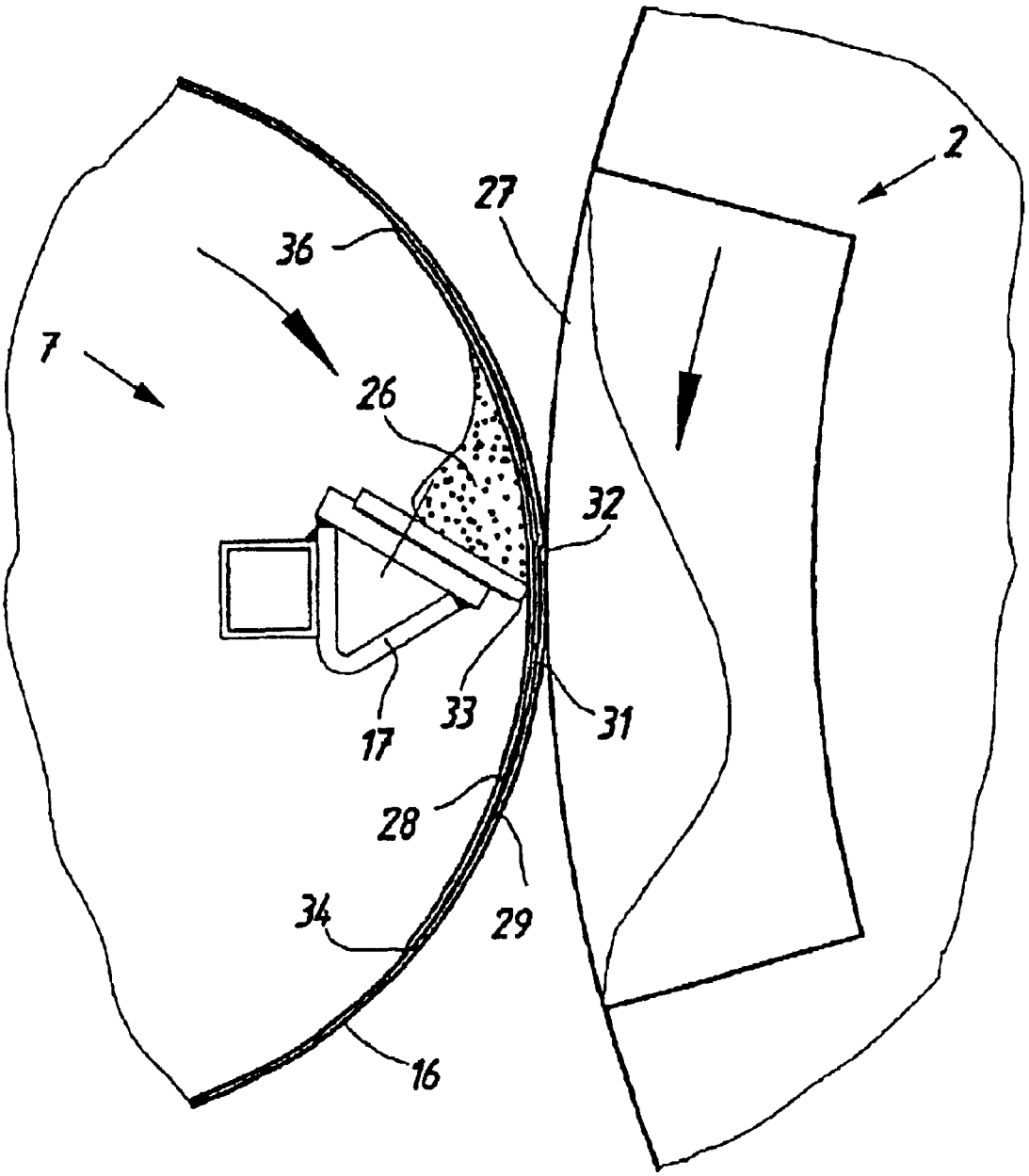

The preferred embodiment of the screen printing cylinder 7 shown in FIG. 7 is suitable for use when the form or plate cylinder 2 does not have any regions that protrude beyond the radius of the printing plates, but perhaps has a concave section, for example a channel 27. The screen printing cylinder 7 in this instance is cylindrical over its entire circumference, without any indented sections. As was the case of the screen printing cylinder 7 shown in FIG. 6, the screen printing cylinder 7 shown in FIG. 7 has a doctor blade 17 disposed inside it, which doctor blade 17 forces or strokes a paste-like ink 26 through the screen 16 which is stretched over the screen printing cylinder 7. Doctor blade 17 thus exerts a radially outward pressure on the screen 16. As long as the screen 16 touches the surface of the form or plate cylinder 2 during the entire rotation of the screen printing cylinder 7 and the plate cylinder 2, then the form or plate cylinder 2 provides an opposing pressure, which prevents the doctor blade 17 from deforming the screen 16. In order to also prevent such a deformation of the screen 16 in the region of the channel 27, where the screen 16 does not contact the plate cylinder 2, a support element 28 is disposed radially inside the screen 16, which support element 28 extends in the circumference direction of the screen printing cylinder 7 and over a circumference section 29 of the screen 16, which corresponds to the size of the channel 27 on the form or plate cylinder 2. The support element 28 is a curved, closed plate made of metal or strong plastic, in the form of a cylinder segment.

The support element 28 in this case is attached radially inside the screen 16 and a leading end 31 and a trailing end 32 of the screen 16 overlap each other in the circumference section 29 supported by the support element 28. This protects the sensitive connection between the two ends 31 and 32 from contact with the doctor blade 17 and therefore from premature wear.

In this configuration of the screen printing cylinder 7, it is not necessary to guide the doctor blade 17 with a guide body like the guide slot 18 from FIG. 6. In lieu of the provision of a guide slot 18, the doctor blade 17 can also be moved slightly in the radial direction, counter to the force of a spring, or can have a flexible lip 33, whose deformation can compensate for slight fluctuations in the radius of the form or plate cylinder 2. In a configuration of this kind, in order to ease the transition of the doctor blade 17 from the screen 16, onto the support element 28, and back onto the screen 16, and to prevent interruptions in the smooth running of the screen printing cylinder 7, the support element 28 is provided with a leading edge 34 and with a trailing edge 36, which are beveled in the circumference direction of the screen printing cylinder 7 and which do not extend exactly parallel to a generatrix of the outer surface of the screen printing cylinder 7 or to the lip 33 of the doctor blade 17, but at a slight angle to them.

While preferred embodiments of an intaglio printer in accordance with the present invention have been set forth fully and completely hereinabove, it will be apparent to one of skill in the art that various changes in, for example the supports for the various cylinders, the drives for the cylinders and the like could be made without departing from the true spirit and scope of the present invention which is accordingly to be limited only by the following claims.

What is claimed is:

1. An intaglio printer comprising:

a plate cylinder;

at least one intaglio printing plate on said plate cylinder, said at least one intaglio printing plate having fine channels adapted to receive gravure ink and large recesses adapted to receive screen printing ink;

means supplying gravure ink to said fine channels of said at least one intaglio printing plate;

a counterpressure cylinder cooperating with said plate cylinder to print material passing between said plate cylinder and said counterpressure cylinder; and at least one screen printing cylinder for transferring a screen printing ink to said large recesses of said at least one intaglio printing plate said large recesses of said at least one intaglio printing plate, which receive said screen printing ink, being larger than said fine channels of said at least one intaglio printing plate, which receive said gravure ink.

2. The intaglio printer of claim 1 further including a steel engraved intaglio printing plate on said plate cylinder.

3. The intaglio printer of claim 1 further including a collecting cylinder associated with said plate cylinder, said collecting cylinder supplying said gravure ink to said fine channels of said at least one intaglio printing plate.

4. The intaglio printer of claim 3 further including a plurality of pattern cylinders associated with said collecting cylinder.

5. The intaglio printer of claim 4 further including an inking unit associated with each of said plurality of pattern cylinders.

6. The intaglio printer of claim 1 further including a wiping device associated with said plate cylinder.

7. The intaglio printer of claim 6 wherein said at least one screen printing cylinder is disposed against said plate cylinder before, in a production direction of the intaglio printer, said wiping device.

8. The intaglio printer of claim 6 wherein said at least one screen printing cylinder is disposed against said plate cylinder after, in a production direction of the intaglio printer, said wiping device.

9. The intaglio printer of claim 1 further including a support element for said at least one screen printing cylinder, said support element extending axially against said screen printing cylinder in a section of said screen printing cylinder, said section having a limited circumferential direction.

10. The intaglio printer of claim 9 wherein said screen printing cylinder includes a screen and further wherein said support element is disposed radially outside of said screen.

11. The intaglio printer of claim 9 wherein said screen printing cylinder includes a screen and further wherein said support element is disposed radially inside of said screen.

12. The intaglio printer of claim 9 wherein said support element includes a leading edge and a trailing edge and further wherein each of said leading and trailing edges extends at an angle to a generatrix of a circumferential surface of said screen printing cylinder.

13. The intaglio printer of claim 12 wherein each of said leading and trailing edges have a form of an elongated helix.

14. The intaglio printer of claim 9 wherein said support element is impermeable to ink.

* * * * *